US006196128B1

(12) United States Patent
Corrado et al.

(10) Patent No.: US 6,196,128 B1
(45) Date of Patent: Mar. 6, 2001

(54) TRAVERSING CONTACT CLEANING ROLLER CLEANER

(76) Inventors: Frank C. Corrado, 33 Gateway Rd., Rochester, NY (US) 14624; James W. Fischer, 118 Bellhurst Dr., Rochester, NY (US) 14617; Gary R. Larsen, 726 Eastwood Cir., Webster, NY (US) 14580; Ronald W. Sweet, 2234 E. Lake Rd., Conesus, NY (US) 14435

( * ) Notice: Subject to any disclaimer, the term of this patent is extended or adjusted under 35 U.S.C. 154(b) by 0 days.

(21) Appl. No.: 09/294,952

(22) Filed: Apr. 20, 1999

(51) Int. Cl.[7] ..... B41F 35/00

(52) U.S. Cl. ..... 101/425; 101/483

(58) Field of Search ..... 101/423, 425, 101/424, 483; 15/256.53, 256.52, 256.51, 256.5, 3, 102; 134/6, 9

(56) References Cited

U.S. PATENT DOCUMENTS

| | | | | |
|---|---|---|---|---|
| 3,851,582 | * | 12/1974 | Saueressig et al. | 101/424.1 |
| 4,009,047 | | 2/1977 | Lindsay | 134/9 |
| 4,982,469 | * | 1/1991 | Nishiwaki | 15/3 |
| 4,994,322 | | 2/1991 | Delgado et al. | 428/343 |
| 5,251,348 | | 10/1993 | Corrado et al. | 15/256.53 |
| 5,275,104 | | 1/1994 | Corrado et al. | 101/425 |
| 5,349,714 | * | 9/1994 | Korbonski et al. | 15/3 |
| 5,611,281 | | 3/1997 | Corrado et al. | 101/425 |
| 5,685,043 | * | 11/1997 | LaMaanna et al. | 15/256.52 |

FOREIGN PATENT DOCUMENTS

| | | | | |
|---|---|---|---|---|
| 63-204728 | * | 8/1988 | (JP) | 101/425 |

* cited by examiner

*Primary Examiner*—John S. Hilten
*Assistant Examiner*—Anthony H. Nguyen

(57) ABSTRACT

A system for cleaning a moving substrate includes a rail mounted adjacent to the substrate surface and substantially transverse to the direction of movement thereof. A carriage for supporting a polymer-covered contact cleaning roller (CCR) is deployed on the rail for allowing axial translation of the CCR transversely of the substrate while in rolling contact therewith. The rail extends beyond at least one longitudinal edge of the substrate by a distance at least equal to the length of the CCR such that the CCR may be translated sufficiently to be brought out of contact with the moving substrate surface, from which position the CCR may be readily and safely renewed by an operator or automatically by any convenient means. The CCR mounted on the carriage may be a primary CCR and the substrate may be an object to be cleaned by the system, or the CCR mounted on the carriage may be a secondary CCR and the substrate may be a primary CCR. The extension of the rail beyond the edge of the substrate defines a renewal station for the rail-borne CCR, either primary or secondary, at which the CCR may be renewed automatically or manually by an operator, as by washing, replacement, or removal of a tape convolution. Separation of the renewal station from the CCR-cleaning portion of the rail permits the renewal station, if so desired, to be located outside the primary CCR cleaning area, the rail passing through a light lock, for example, if the substrate must be cleaned in the dark, or an air lock if the substrate must be cleaned in a toxic or otherwise unhealthy atmosphere.

18 Claims, 9 Drawing Sheets

TRAVERSING CONTACT CLEANING ROLLER CLEANER

DESCRIPTION

The present invention relates to methods and apparatus for cleaning particulate contamination from a substrate surface which may be a roller surface, more particularly to methods and apparatus for using a contact cleaning roller to pick up particles from a substrate surface which may be another roller surface, and most particularly to methods and apparatus for traversing a short contact cleaning roller axially along a substrate surface which may be the surface of a longer process roller for transferring contaminant particles from the process roller to the contact cleaning roller. The process roller may be a contact cleaning roller.

In many manufacturing processes involving substrates, for example, in continuous-web printing and in the coating of photographic films and papers, particulate contamination of the substrate surface can lead to reduced quality of the coated product and to increased waste. It is known to use a polymer-covered roller in rolling contact with a planar substrate to remove particles from the surface of the planar substrate ahead of the printing or coating point. It is also known to use a polymer-covered roller in rolling contact with another roller, for example, a process roller such as another contact cleaning roller, calendar roller, offset printing roller, and the like. The surface of such a polymer-covered roller (known in the art as a contact cleaning roller and also referred to herein as a CCR), may comprise a polymer having a high surface energy, for example, polyurethane or silicone rubber, or alternatively, a polymer exhibiting adhesive tack, such as any of the well-known tape adhesives. The CCR surface exhibits a greater attraction for particles than does the substrate surface, so that particles are transferred from the substrate to the CCR at the point of rolling contact.

A CCR may itself function as a conveyance roller, for example, in a string of web conveyance rollers, in which use the CCR may enjoy a substantial angle of wrap of the web, for example, a wrap angle of 90° or even greater. A conveyance roller as used herein is a roller whose position defines a portion of a web conveyance path. Such engagement by a CCR may be on either side of the web being conveyed. See, for example, U.S. Pat. No. 5,251,348 issued Oct. 12, 1993 to Corrado et al. A CCR may also function as a non-conveyance roller, that is, the web conveyance path is not a function of the presence or absence of the CCR. In such use, a CCR typically is positioned as a nip roller urged against a non-CCR conveyance roller (backing roller), the web passing therebetween, whereby the web is conveyed on a first or back side against the conveyance roller and is cleaned on a second or front side by the CCR. See, for example, U.S. Pat. No. 5,611,281 issued Mar. 18, 1997 to Corrado et al. which is hereby incorporated by reference.

Many substrates, for example, web substrates, have particulate contamination concentrated along the outer edges of the substrate surface which can lead to premature clogging and failure of a full-width CCR while more central portions of the CCR surface are still non-clogged and serviceable. The U.S. Pat. No. 5,611,281 patent discloses to prolong the useful life of a CCR between renewals (removal of accumulated particles) by oscillating the CCR axially while it is rolling along the substrate surface, thereby causing accumulating particles to be distributed as a broad band over a substantial portion of the axial length of the roller along each substrate edge.

Through use, the surface of a CCR becomes progressively clogged with removed particles and progressively loses cleaning effectiveness. Cleaning, also known as renewal, of a CCR surface may be accomplished through washing, for example, as disclosed in U.S. Pat. Nos. 5,275,104, 5,611,281, wherein a plurality of CCR's are alternably provided such that continuous cleaning of the substrate surface can be maintained while each CCR in turn is rotated out of service for off-line renewal, including drying. This is necessary because washing of a CCR while in service against a substrate risks undesirable transfer of cleaning fluid onto the substrate.

Alternatively, as disclosed in the '281 patent, a higher-tack CCR may be engaged to clean particles from a lower-tack CCR (which procedure is defined hereby as secondary cleaning) which itself has cleaned, or is actively cleaning, particles from some other substrate surface such as a web (which procedure is defined hereby as primary cleaning). For continuous primary cleaning, this arrangement requires continuous contact of the primary CCR with the substrate. Thus, a problem arises as to how to clean or renew the secondary CCR without reverse-contaminating the primary CCR and, indirectly, the substrate being cleaned.

Typically, a secondary CCR, like a primary CCR, comprises either a solid polymer covered roller or a length of adhesive tape wound on a core with the adhesive surface facing outwards. Renewal of either type of secondary CCR requires first that the roller be retracted from contact with the primary CCR to avoid contamination thereof. A solid polymer secondary CCR may then be washed automatically, as referenced above, or manually by an operator, either in place or after being removed to a washing station. A tape-type secondary CCR is renewed either by unwinding and discarding the exposed tape to present a fresh convolution or by replacing the roll of tape when spent, as disclosed in U.S. Pat. No. 4,009,047.

For some primary CCR installations, for example, those involving very long CCR's as in many paper and plastic web manufacturing processes, full-length secondary CCR's become prohibitively expensive or impractical. Adhesive tape may not be available in sufficient wound width, for example, four or five meters, to match the length of a primary CCR, and even if available, the viscous drag resulting from full-length contact can stall or prevent the primary CCR from turning as an idler roller in synchrony with the web being conveyed. Operator handling of such rolls for stripping of a spent adhesive convolution or for replacement of a spent roll can be cumbersome, difficult, and dangerous and can prove to be impossible in some situations, for example, in the dark conditions required for photographic manufacturing. Further, in installations wherein an adhesive-tape secondary CCR must be disposed below the primary CCR, the tape roll may sag in the middle under its own weight, preventing proper contact of the tape surface with the entire length of the primary CCR.

Thus there is a need for a method and apparatus for providing renewal cleaning of a primary CCR by a secondary CCR which permits easy, safe renewal of the secondary CCR, which apparatus may also be adapted to renewal cleaning of a primary CCR by means other than a secondary CCR. There is a further need for a method and apparatus wherein the motion and contact of secondary CCR with a primary CCR is completely controllable.

It is a principal object of the invention to provide an improved method and apparatus for safe, inexpensive, and simple renewal of a primary and/or secondary CCR.

It is a further object of the invention to provide an improved method and apparatus whereby a primary CCR may be effectively and reliably cleaned by a secondary CCR independent of the length or diameter of the primary CCR.

It is a still further object of the invention to provide an improved method and apparatus whereby a secondary CCR may follow a programmed sequence of motions for cleaning various portions of a primary CCR.

Briefly described, a system for cleaning a moving substrate includes a rail mounted adjacent to the substrate surface and substantially transverse to the direction of movement thereof. A carriage for supporting a contact cleaning apparatus, which may be, for example, a non-rotatable cloth web or sponge pad as disclosed in U.S. Pat. No. 5,275,104 which is hereby incorporated herein by reference, and preferably is a rotatable polymer-covered contact cleaning roller, is rollably deployed on the rail for allowing axial translation of the contact cleaning apparatus transversely of the substrate while in contact therewith. The rail extends beyond at least one longitudinal edge of the substrate by a distance at least equal to the length of the contact cleaning apparatus such that the apparatus may be translated sufficiently to be brought out of contact with the moving substrate surface, from which position the cleaning apparatus, for preferable example, a contact cleaning roller, may be readily and safely renewed by an operator or automatically by any convenient means. Movement of the carriage is controlled by a motor and by a programmable controller. Preferably, the CCR may also be lifted on the carriage in a direction orthogonal to the direction of rail travel to separate the CCR from the substrate surface as desired.

In a first preferred embodiment, a contact cleaning apparatus mounted on the carriage is a primary CCR and the substrate is an object such as a web to be cleaned by the apparatus and method of the system.

In a second preferred embodiment, the contact cleaning apparatus mounted on the carriage is a secondary CCR and the substrate is a primary CCR for cleaning an object such as a web. The primary CCR is positionable to be in contact with a surface of a substrate to be cleaned and may also be positionable to be out of contact with the substrate surface as desired. The primary CCR may be controllably displaceable axially of itself or it may be axially fixed. The secondary CCR may be moved axially along the surface of the primary CCR either in contact or out of contact therewith in response to a programmable controller.

The extension of the rail beyond the edge of the substrate to be cleaned defines a renewal station for the rail-borne CCR, either primary or secondary.

In operation, either the primary or secondary CCR may be driven in any desired program of cleaning contact with its respective substrate. For example, in the first embodiment, the primary CCR may be driven to the renewal station for renewal between successive lengths of substrate. In a simple cleaning cycle of the second embodiment, the secondary CCR in non-contact mode may be driven to the rail end opposite the renewal station, brought to linear surface speed match with the primary CCR, engaged into cleaning attitude with the primary CCR, traversed axially at a predetermined speed along the primary CCR to the renewal station (passing across the edge of the substrate), and retracted from cleaning attitude to be returned for another cycle or held at the renewal station for renewal. The primary CCR continues to clean the substrate during all portions of the secondary CCR cycle. Other modes are possible; for example, the secondary CCR may be cycled repeatedly over those portions of the primary CCR which clean along the edges of the substrate, where particle contamination may be more prevalent, cleaning other portions of the primary CCR less frequently. Preferably, the secondary CCR is translated in contact with the primary CCR in only one direction, the reverse direction being reserved for out-of-contact return. This arrangement causes the particle load on the secondary CCR to be heaviest toward the lead end of the roller and leaves the trailing end of the roller relatively clean, thereby preventing tracking back of accumulated particles onto the freshly cleaned primary CCR surface.

If desired, an additional carriage and primary or secondary CCR may be installed on the same rail and a second renewal station for the additional CCR may be provided at the rail end opposite the first renewal station by similarly extending the rail outboard of the opposite edge of the substrate.

At the renewal station, the CCR may be renewed automatically or manually by an operator, as by washing, replacement, or removal of a tape convolution. Separation of the renewal station from the CCR-cleaning portion of the rail permits the renewal station, if so desired, to be located outside the primary CCR cleaning area, the rail passing through a light lock, for example, if the substrate must be cleaned in the dark, or an air lock if the substrate must be cleaned in a toxic or otherwise unhealthy atmosphere.

Two substantially identical CCR cleaning systems in accordance with the invention may be disposed on opposite sides of a substrate to clean both sides in a single pass of the substrate through the apparatus.

The foregoing and other objects, features, and advantages of the invention, as well as presently preferred embodiments thereof, will become more apparent from a reading of the following description in connection with the accompanying drawings in which:

FIG. 1 is a schematic side elevational view of a traversing roller cleaner system in accordance with the invention, showing a primary CCR in nipped relationship with a backing roller for cleaning a surface of a substrate passing therebetween and a secondary CCR in nipped relationship with the primary CCR and mounted on a traversing apparatus for moving the secondary CCR along the surface of the primary CCR to clean it;

Figure 4:
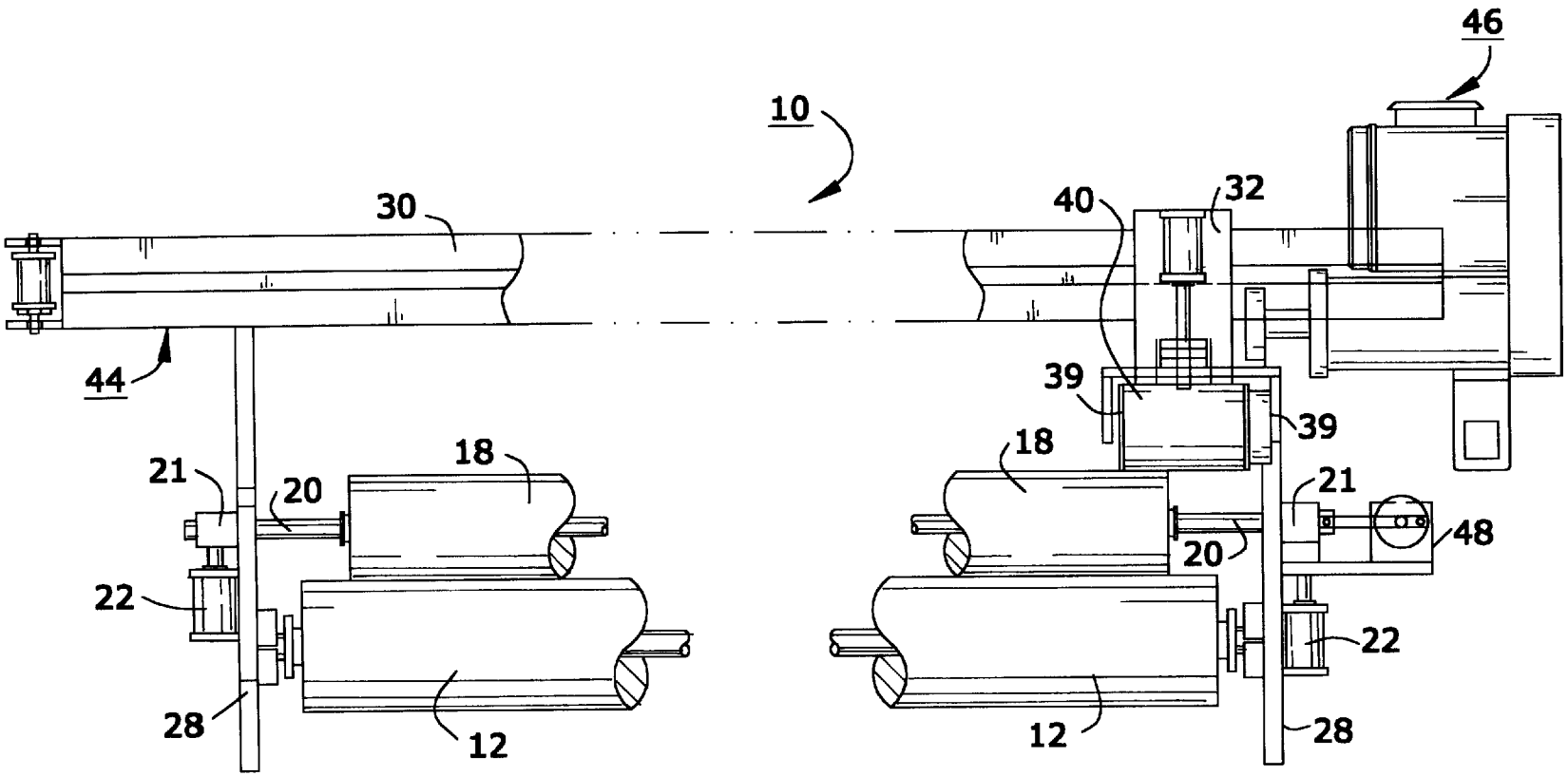
FIG. 4 is a front elevational view of like the schematic view shown in FIG. 2 but showing more detail, especially the secondary CCR in axial position to begin a cleaning traverse of the primary CCR.
Figure 5:
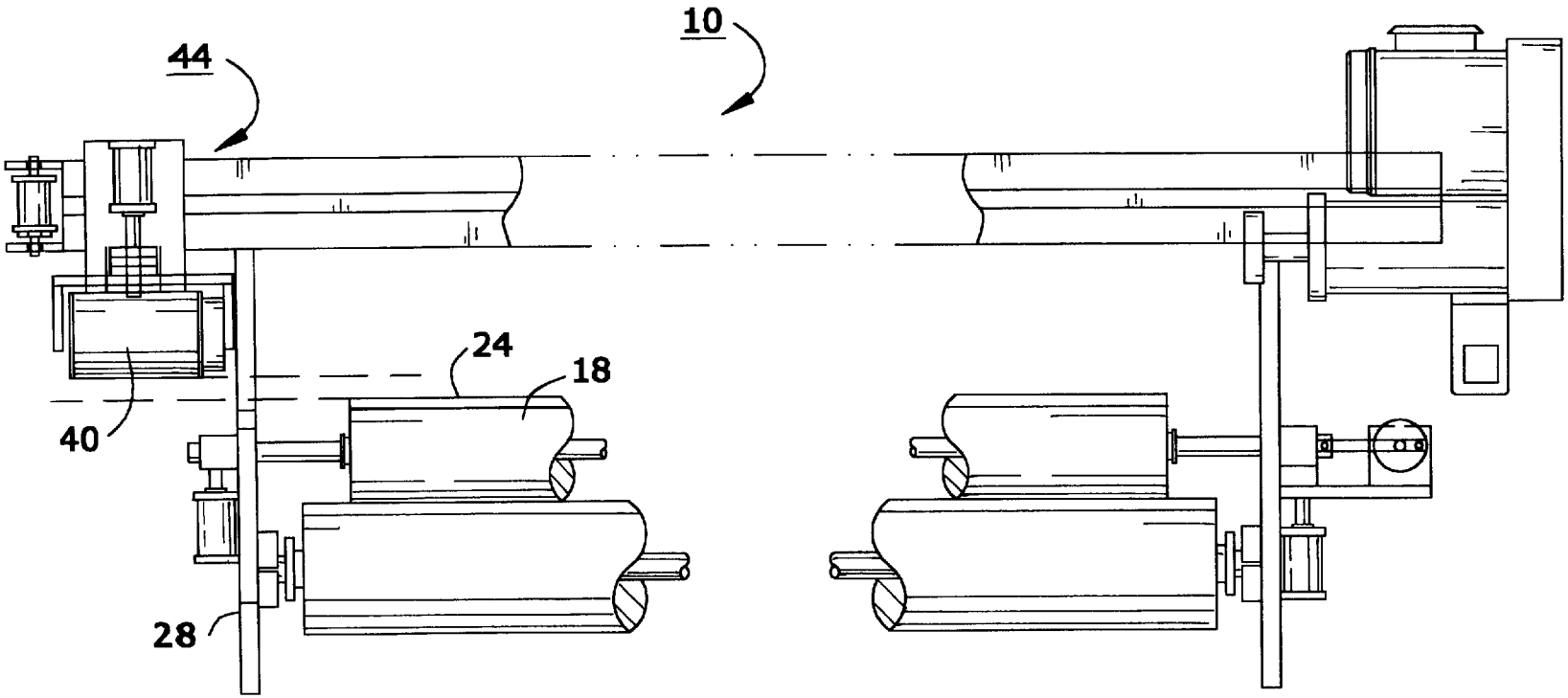
FIG. 5 is a front elevational view like that shown in FIG. 4, showing the secondary CCR at a renewal station at completion of a cleaning traverse across the primary CCR.
Figure 5A:
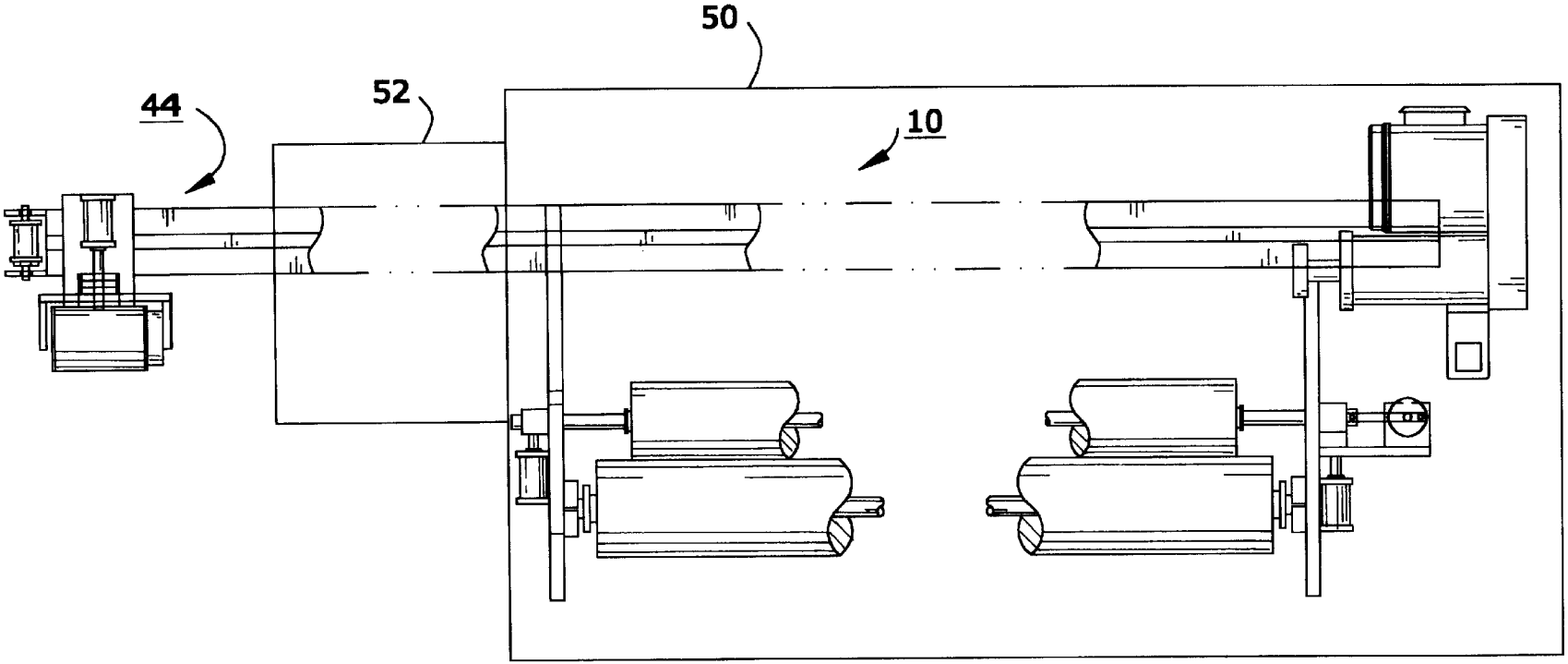
Figure 6:
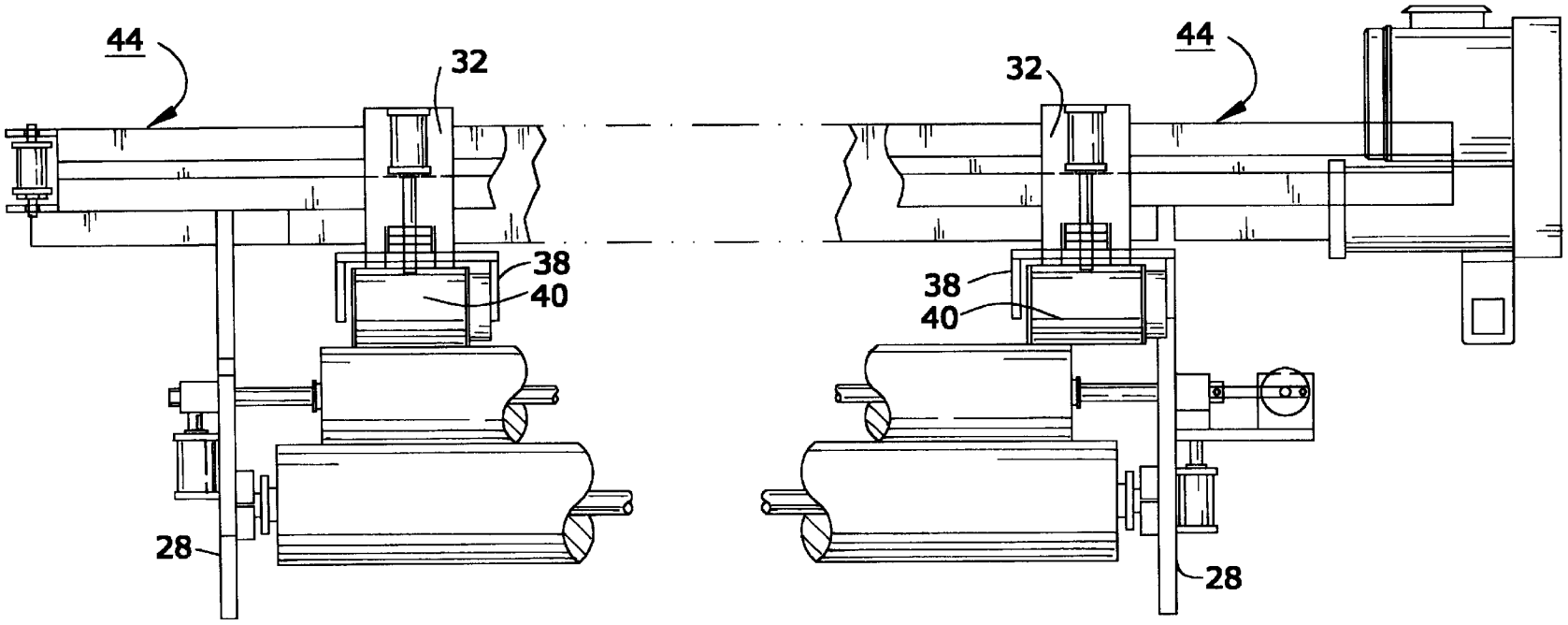
Figure 7:
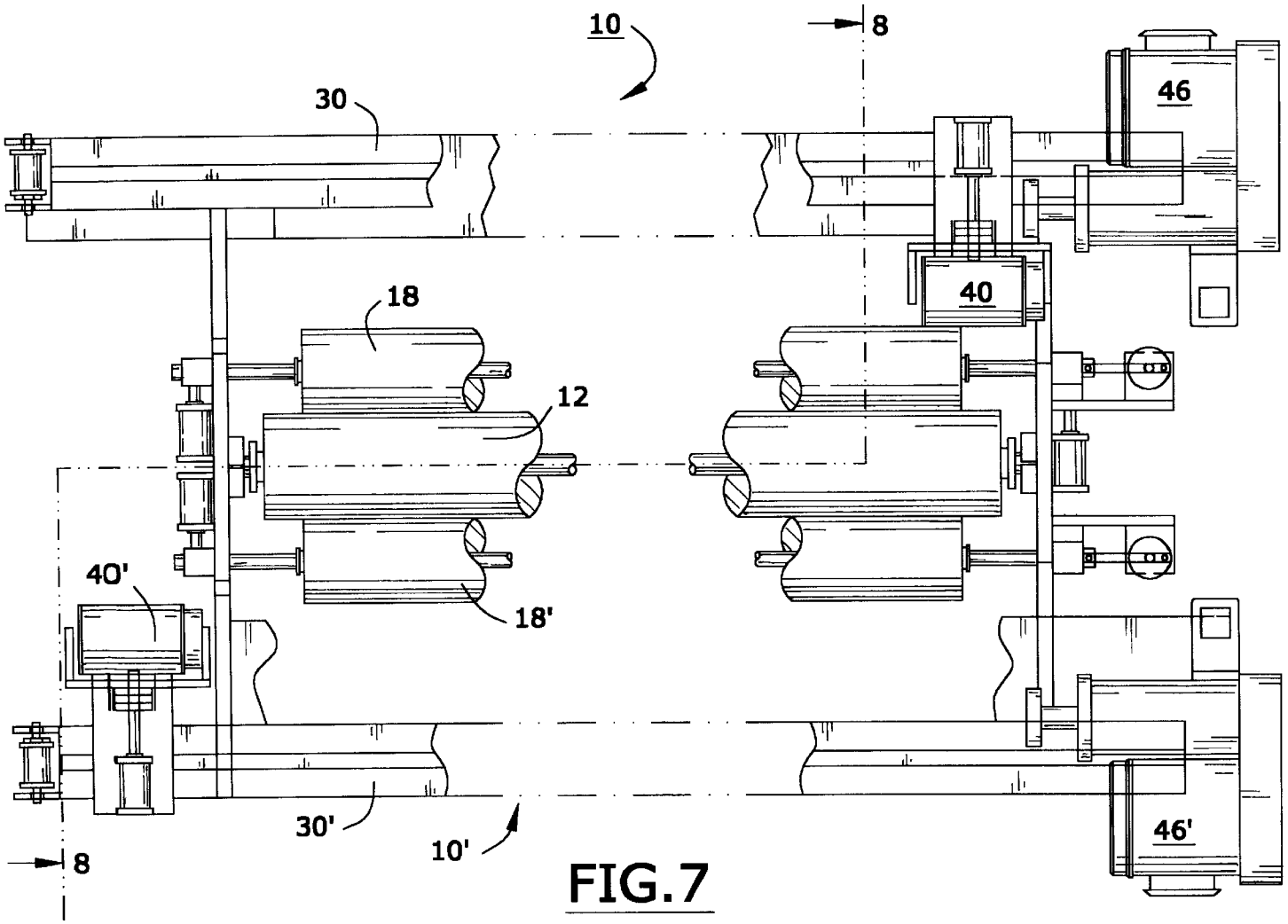
Figure 8:
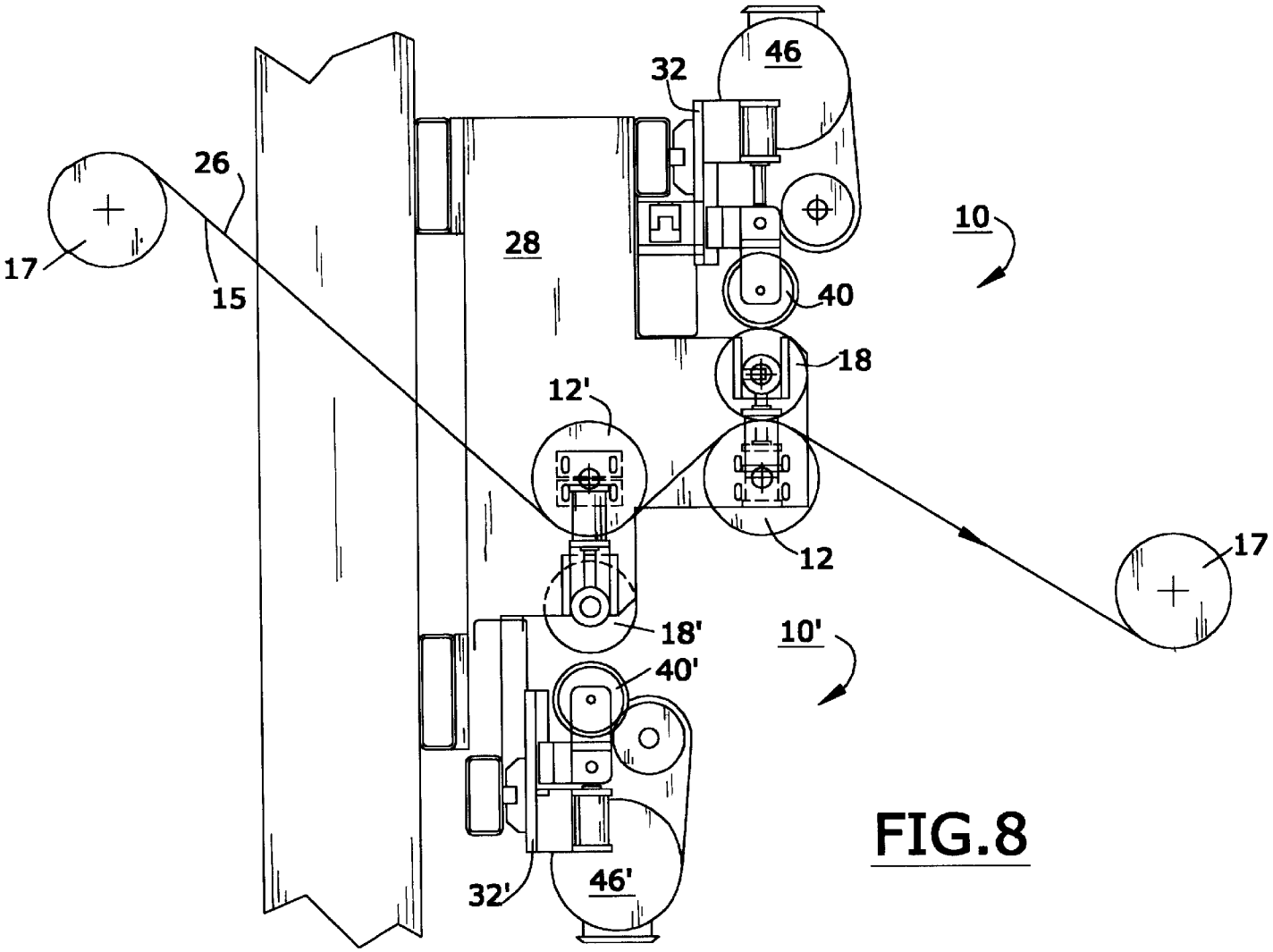
Figure 9:
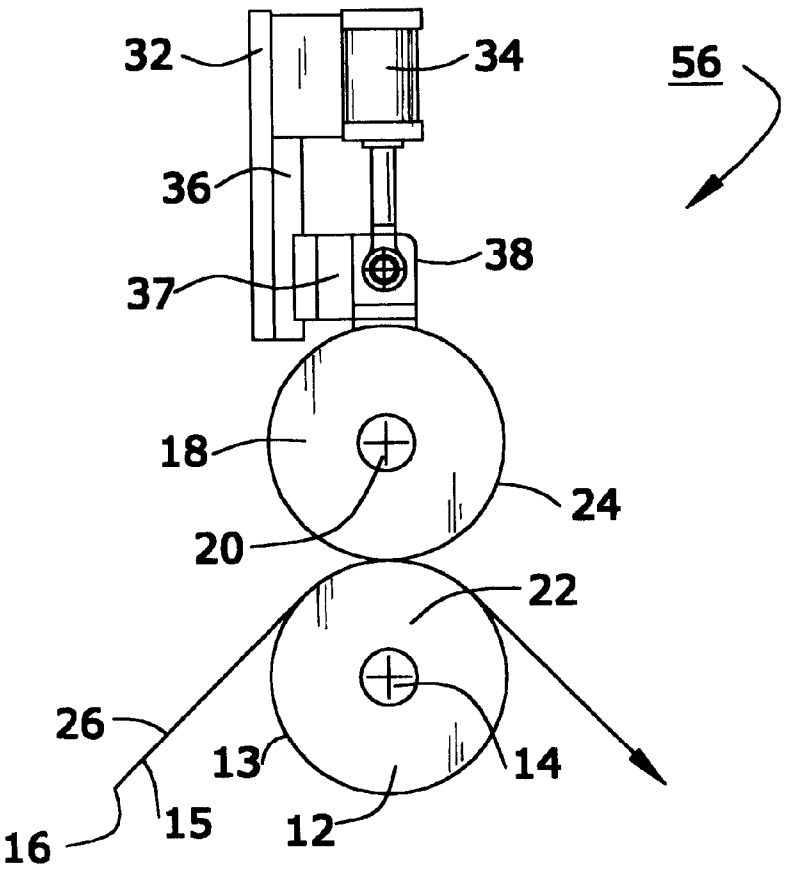

FIG. 5*a* is a front elevational view like that shown in FIG. 5, showing the renewal station outside a CCR cleaning enclosure, including a passage lock for access thereto;

FIG. 6 is a front elevational view like that shown in FIGS. 4 and 5, showing an installation having tandem secondary CCR's;

FIG. 7 is a front elevational view like that shown in FIGS. 4 and 5, showing a dual installation for cleaning opposed primary CCR's mounted for cleaning both sides of a substrate in one pass through the apparatus;

FIG. 8 is a side elevational view taken along line 8—8 in FIG. 7; and FIG. 9 is a schematic side elevational view of a traversing roller cleaner system in accordance with the invention, showing a primary CCR in nipped relationship with a backing roller for cleaning a surface of a substrate passing therebetween, the primary CCR being mounted on a traversing apparatus for moving it along the surface of the primary CCR to clean it and for removing it beyond the edge of the substrate to a renewal station.

The invention is defined by the claims. Apparatus and methods in accordance therewith are useful in processes for cleaning flexible substrates comprising, but not limited to, plastic, metal, and paper webs and sheets, and rigid planar substrates comprising, but not limited to, circuit boards and silicon wafers. (Note: A substrate is shown only in FIGS. 1, 3, 8, and 9; it is omitted from all other figures for clarity of presentation although its presence should be inferred therein.) Referring to FIGS. 1 through 5, there is shown a system 10 in accordance with the invention for continuous cleaning of a substrate surface by means of continuous contact with a primary contact cleaning roller, and for discontinuously cleaning of the primary contact cleaning roller by discontinuous contact with a secondary contact cleaning roller, and for discontinuous renewal of the secondary contact cleaning roller.

A conveyance roller 12 is disposed for rotation about shaft 14 for conveying a substrate 16 such as a web, the web conveyance path optionally including adjacent conveyance rollers 17. Roller 12 may be driven (by conventional means, not shown) or may be an idle roller turned by frictional contact of roller surface 13 with first surface 15 of substrate 16 which itself may be drawn along its web path by driven rollers (not shown). Primary contact cleaning roller (CCR) 18 is disposed in nipped relationship with conveyance roller 12, substrate 16 passing therebetween, and shaft 20 of roller 18 being journalled in bearings 21 and being parallel with shaft 14 of roller 12.

Figure 2:
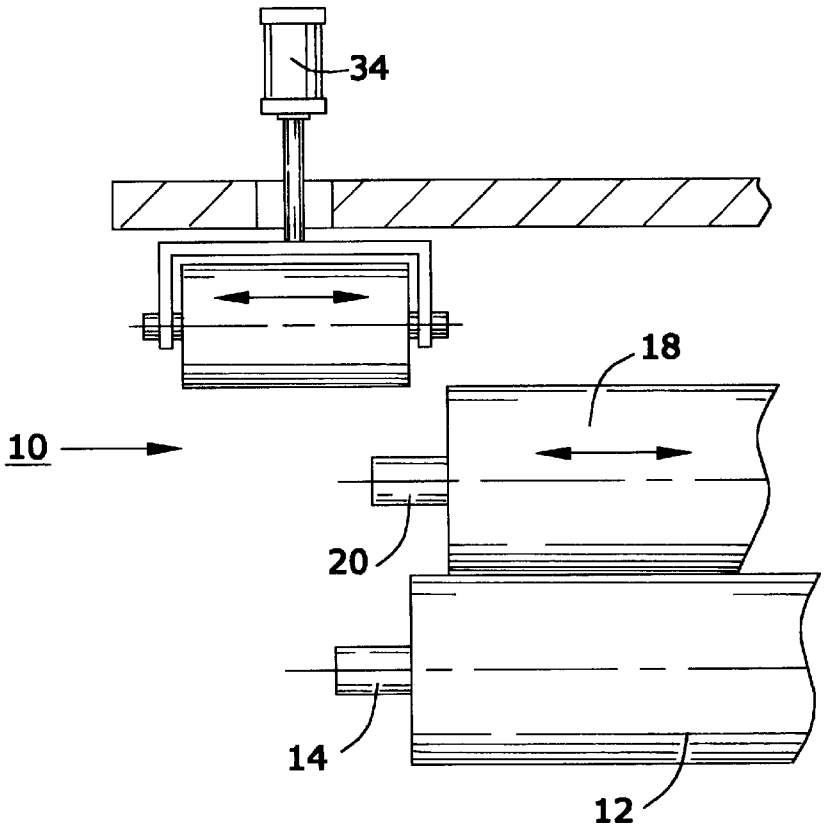
FIG. 2 is a schematic front elevational view taken along line 2—2 in FIG. 1.
Figure 1:
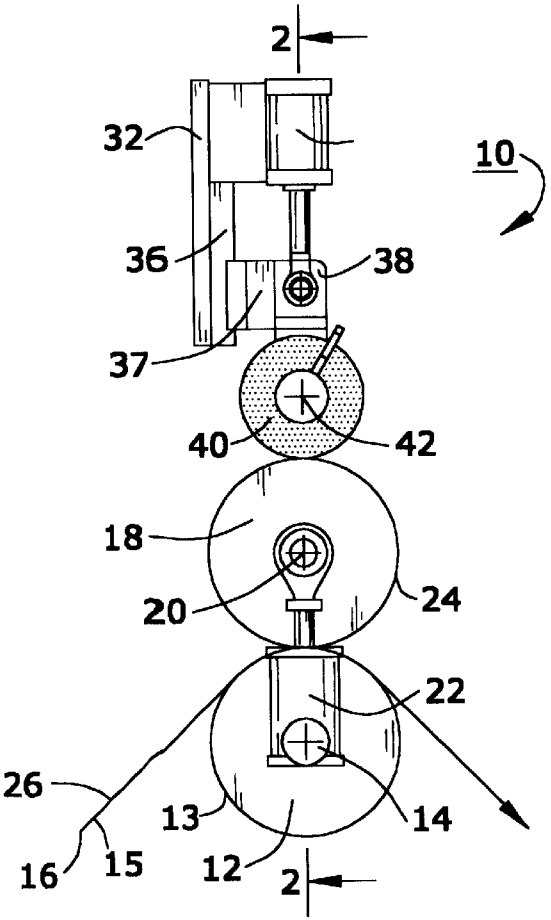
Figure 3:
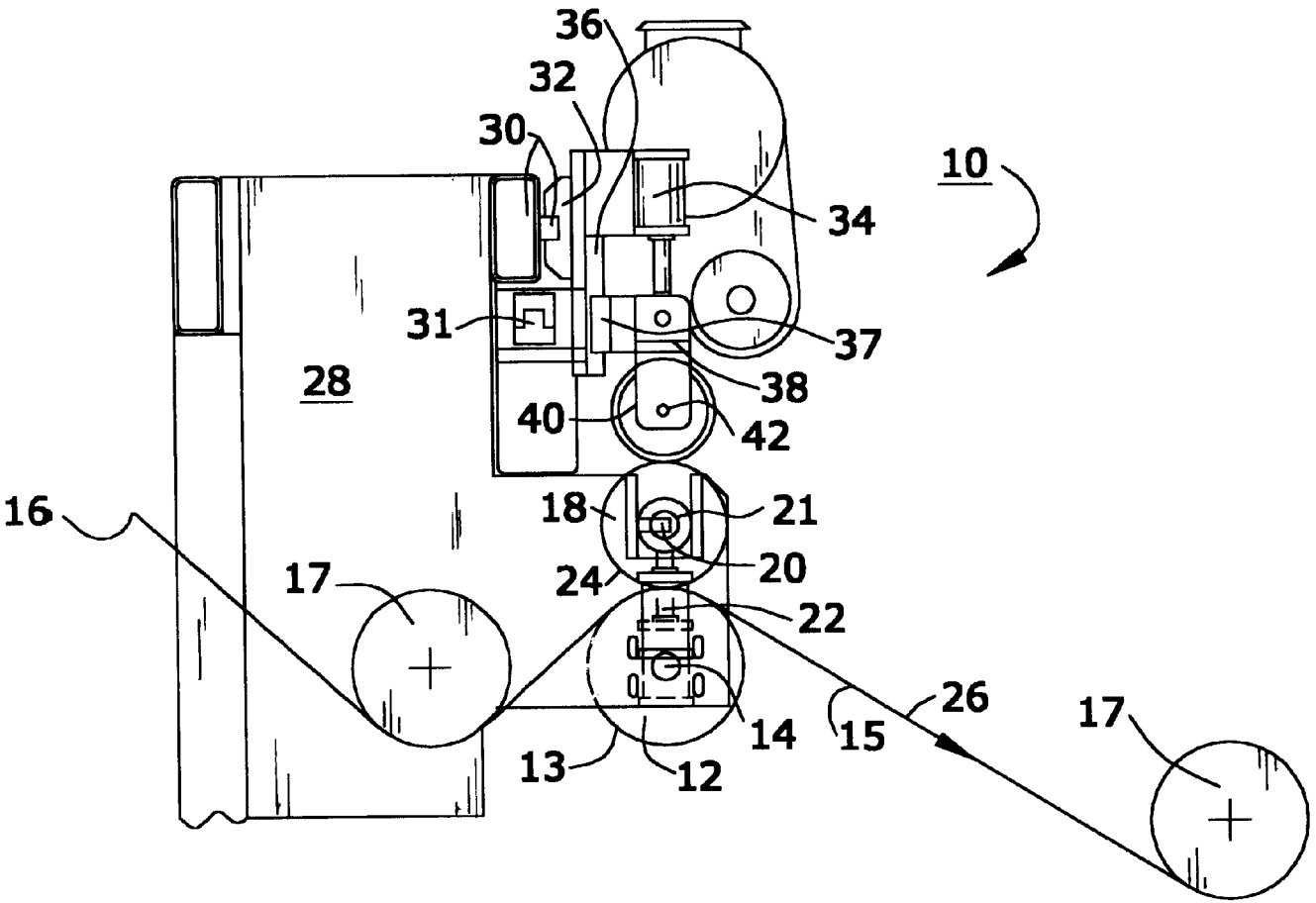
FIG. 3 is a side elevational view like the schematic view shown in FIG. 1 but showing more detail.

The outer shell of primary CCR 18 may be formed of a resilient polymer having an electrically active surface, for example, silicone rubber, neoprene, butyl rubber, or preferably polyurethane as disclosed in U.S. Pat. No. 5,611,281. Alternatively, the outer shell of CCR 18 may comprise, for example, a pressure sensitive adhesive coated tape disposed adhesive side out, as disclosed in U.S. Pat. No. 4,009,047. An example of an adhesive suitable for such use is a tacky polymeric elastomeric alkyl acrylate or alkyl methacrylate ester material, as disclosed in U.S. Pat. No. 4,994,322. CCR 18 may be axially fixed or may be axially translated as shown in FIG. 2 and disclosed in U.S. Pat. No. 5,611,281.

CCR 18 may be urged toward conveyance roller 12 by gravity or, preferably, by one or more pneumatic actuators 22 mounted on frame side members 28 and connected to shaft 20 via bearings 21 at one or both ends thereof, and operatively connected for conventional pneumatic control to open and close the nip by means not shown. Bearings 21 are slidably mounted in members 28. In nip-closed position, surface 24 of CCR 18 is in rolling contact with second surface 26 of web 16 and thereby upon rotation can transfer loose and electrostatically-bound particles from web surface 26 to CCR surface 24.

Frame side members 28 also support a rail 30 disposed transverse of and off-spaced from substrate 16 in substantially parallel relationship therewith. Rail 30 supports a drive belt 31, for traversing a movable carriage 32 along rail 30, on which carriage are mounted a pneumatic actuator 34 similar to actuator 22, a vertical guide 36, and a bracket 38 for receiving guide 36 in a guide flange 37 thereof. Bracket 38 supports a secondary contact cleaning roller 40 for rotation about a shaft 42 substantially parallel with shafts 14 and 20. CCR 40 may be engaged with or retracted from CCR 18 by actuator 34 and may be translated into or out of overlapping relationship with CCR 40 along rail 30 by drive belt 31. In FIGS. 4, 6, and 7, CCR 40 is shown as overlapping CCR 18, and in FIGS. 2, 5, and 5*a*, is shown as non-overlapping. "Overlapping" is defined herein as a relationship in which the surface of a CCR may be brought into or out of contact with a substrate surface to be cleaned by movement of either the CCR or the substrate in a direction orthogonal to the axial direction of the CCR. Roller 40 preferably is axially shorter than the axial length of the cleaning surface of primary CCR 18, preferably much shorter and may be as short as one-tenth or one-twentieth or less of the length thereof.

The surface of secondary CCR 40 may be similar to the surface of primary CCR 18, in that it may be formed of a resilient polymer having a high surface energy such as polyurethane, silicone rubber, butyl rubber, neoprene, or the like, or it may be formed of a tacky polymer such as a tape adhesive, for example, CCR 40 may comprise a multiple-convolution roll of adhesive tape wound on a hollow core with the adhesive side facing outwards. A suitable tape, for example, is "Scotch Brand Tape No. 850" available from 3M Corporation, St. Paul, Minnesota, or its equivalent. Whatever material is selected for the surface of CCR 40, it is important that the surface tack be substantially greater than the surface tack of primary CCR 18 to assure transfer of particles to CCR 40. When CCR 40 comprises a resilient polymer, the roller is preferably formed as a polymer shell on a tubular metal mandrel which may be mounted to bracket 38 by spring-biased tapered gudgeons 39 which fit into the open ends of the mandrel. Thus, a single configuration of bracket and gudgeons can accommodate alternatively either the resilient polymer or tacky tape form of secondary CCR 40.

Rail 30 extends beyond side frames 28 by a length sufficient to accommodate at a first end thereof the entire carriage assembly of secondary CCR 40, as shown in FIG. 5, defining thereby a renewal station 44 for CCR 40, and at a second end thereof optional and preferable speed matching apparatus 46 for bringing a renewed and non-nipped CCR 40 to the same surface speed as CCR 18 before re-engaging CCR 40 therewith, as shown in FIG. 4 (after speed matching and reengagement). The speed matching apparatus is similar to that disclosed in U.S. Pat. No. 5,611,281.

Primary CCR 18 optionally may be adapted for axial oscillation while cleaning a substrate passing between CCR 18 and roller 12, via the action of mechanical oscillator 48 connected to shaft 20, substantially as disclosed in U.S. Pat. No. 5,611,281.

The operation of all elements of system 10 may be controlled and synchronized by a programmable controller in known fashion.

In operation, a typical cycle of secondary CCR 40 begins with CCR 40 in retracted mode in renewal station 44, as shown in FIG. 5. CCR 40 is renewed in known fashion as by operator replacement with a fresh roller or by washing or by removal of a spent convolution of tape. Renewed CCR 40 is traversed in retracted mode along rail 30 by drive belt 31 to a position preferably overlapping the opposite end of primary CCR 18. CCR 40 is then brought to the linear surface speed of CCR 18 by speed matching apparatus 46 and is then engaged with CCR 18, as shown in FIG. 4. CCR 40 is then drawn axially along the surface of CCR 18 at a predetermined rate to transfer particles therefrom. The ratio of the axial translation speed to the linear surface speed of rotation of CCR's 18 and 40 may be as large as about 0.1 or larger if so desired. Such ratios can be sustained in many applications without risk of damage to either of the rollers.

It is an advantage of the invention that renewal of secondary CCR 40 may be performed at a location remote from the area of cleaning of primary CCR 18 simply by extending rail 30 from the cleaning area to such remote location for the renewal station 44 as shown in FIG. 5*a*. For example, primary cleaning may be required to be performed in an enclosure 50 under operator-adverse conditions. For example, photographic webs may require darkness, other types of substrates may require fume or thermal conditions which would be hazardous to operators, and still other substrates may require subatmospheric or vacuum conditions for cleaning. CCR 40 may be passed into and out of enclosure 50 on rail 30 via a lock 52, which may be a light lock, a vapor lock, a pressure lock, or a vacuum lock, or the like as needed, in accordance with known technology.

In some applications, as shown in installation 54 in FIG. 6, it may be desirable to have two individual secondary CCR's 40 on individual brackets 38, both brackets being connected via carriages to a single drive belt 30 at a predetermined separation from each other such that each secondary CCR cleans a designated portion of the surface of primary CCR 18, which portions may be caused to overlap. Such installation requires that rail 30 be sufficiently long to allow a renewal station 44 at each end of rail 30.

Referring to FIGS. 7 and 8, substantially identical cleaning systems 10,10' having substantially identical parts may be disposed on opposite sides of substrate 16 to clean both surfaces thereof in a single pass of the substrate through the apparatus.

Referring to FIG. 9, which shows embodiment 56, primary CCR 18 may be mounted directly to carriage 32 substantially identically with the mounting of secondary CCR 40 in the foregoing discussion, a secondary CCR being omitted. CCR 18 is thus capable of overlapping substrate 16 and of being oscillated axially along rail 30 for direct cleaning of surface 26 of substrate 16, as disclosed in U.S. Pat. No. 5,611,281, and is further capable of being driven to a non-overlapping position at renewal station 44 for renewal as disclosed herein.

From the foregoing description, it will be apparent that there has been provided an improved method and apparatus for cleaning particles from a moving substrate, wherein a contact cleaning roller is translated along a rail axially of itself and transversely of the substrate while in rolling contact with a surface of the substrate for cleaning particles therefrom, and wherein the path of translation of the contact cleaning roller extends beyond the edge of the substrate by a distance equal to at least the length of the contact cleaning roller to a station for renewal of the contact cleaning roller. Variations and modifications of the herein described improved method and apparatus, in accordance with the invention, will undoubtedly suggest themselves to those skilled in this art. Accordingly, the foregoing description should be taken as illustrative and not in a limiting sense.

What is claimed is:

1. A system for cleaning particles from a first surface of a web substrate, comprising:

a) a frame;

b) a primary contact cleaning roller mounted on said frame for transferring particles from said first substrate surface to a surface of said primary contact cleaning roller;

c) a secondary contact cleaning apparatus mounted on said frame substantially parallel to and overlappable of said primary contact cleaning roller and having a surface disposable into contact with said surface of said primary contact cleaning roller for transferring said particles from said primary contact cleaning roller surface to said secondary contact cleaning apparatus surface;

d) means for axially translating said secondary contact cleaning apparatus into and out of an overlapped relationship with said primary contact cleaning roller, said out of overlapped relationship defining a station for renewal of said cleaning apparatus; and e) an enclosure surrounding said frame and said primary contact cleaning roller and said secondary contact cleaning apparatus, said enclosure having an opening and said means for translating extending through said opening such that said renewal station is located outside of said enclosure.

2. A system in accordance with claim 1 further comprising a conveyance backing roller in nipped relationship with said primary contact cleaning roller, said substrate passing therebetween.

3. A system in accordance with claim 1 wherein said means for axially translating includes a fixed rail mounted on said frame, a carriage movable on said rail for supporting said secondary contact cleaning roller, and means for moving said carriage along said rail.

4. A system in accordance with claim 1 wherein said surface of said secondary contact cleaning roller includes a polymer selected from the group consisting of polyurethane, silicone rubber, butyl rubber, neoprene, and tacky adhesive.

5. A system in accordance with claim 1 wherein said secondary contact cleaning roller comprises a length of adhesive tape wound on a core and having the adhesive side of said tape facing outwards from said core.

6. A system in accordance with claim 1 further comprising means for moving said primary contact cleaning roller and said secondary contact cleaning apparatus into and out of surface contact with each other.

7. A system in accordance with claim 1 further comprising means for matching the linear surface speed of said secondary contact cleaning roller to the linear surface speed of said primary contact cleaning roller when said rollers are out of surface contact.

8. A system in accordance with claim 1 further comprising means for causing said primary contact cleaning roller to be displaced axially thereof while said roller is in rolling contact with said substrate surface.

9. A system in accordance with claim 1 wherein said cleaning surface of said secondary contact cleaning roller is shorter in an axial direction than is said cleaning surface of said primary contact cleaning roller.

10. A system in accordance with claim 9 wherein the ratio of said surface lengths of said secondary and primary contact cleaning rollers is less than about 0.5.

11. A system in accordance with claim 10 wherein said ratio is less than about 0.1.

12. A system in accordance with claim 1 wherein said primary and secondary contact cleaning rollers are rotatable at a linear surface speed defining a first speed and wherein the linear rate of said axial translation of said secondary contact cleaning roller defines a second speed, and wherein the ratio of said second speed to said first speed is less than about 0.5.

13. A system in accordance with claim 12 wherein said ratio is less than about 0.1.

14. A system in accordance with claim 1 further comprising a conditions lock disposed along said translating means between said enclosure and said renewal station.

15. A system in accordance with claim 14 wherein said lock is selected from the group consisting of light lock, vapor lock, pressure lock, and vacuum lock.

16. A system in accordance with claim 1 further comprising a second renewal station at an opposite end of said translating means from said first renewal station.

17. A system in accordance with claim 1 further comprising:

b) a second primary contact cleaning roller mounted on said frame opposite said first primary contact cleaning roller, said substrate passing therebetween, for transferring particles from a second surface of said substrate to a surface of said second primary contact cleaning roller;

c) a second secondary contact cleaning apparatus mounted on said frame substantially parallel to and overlappable of said second primary contact cleaning roller and having a surface disposable into contact with said surface of said second primary contact cleaning roller while said and said second apparatus are in an overlapped relationship for transferring said particles from said second primary contact cleaning roller surface to said second secondary contact cleaning apparatus;

d) second means for axially translating said second secondary contact cleaning apparatus into and out of an overlapped relationship with said second primary contact cleaning roller, said out of overlapped relationship defining a second station for renewal of said cleaning apparatus, said enclosure having a second opening and said second means for translating extending through said second opening such that said second renewal station is located outside of said enclosure.

18. A method of renewing a surface of a primary contact cleaning roller in an enclosure, comprising the steps of:

a) providing a secondary contact cleaning roller in overlapping relationship in said enclosure with said primary contact cleaning roller;

b) engaging the surface of said secondary contact cleaning roller in nipped contact with said surface of said primary contact cleaning roller;

c) first translating said secondary contact cleaning roller along said primary contact cleaning roller for a first distance in a first direction to a renewal station outside said enclosure;

d) renewing said secondary contact cleaning roller;

e) second translating said secondary contact cleaning roller for a second distance in a second direction opposite to said first direction; and f) repeating steps b) through e) to renew said primary contact cleaning roller surface.

* * * * *